US005180007A

United States Patent [19]

Manke et al.

[11] Patent Number: 5,180,007

[45] Date of Patent: Jan. 19, 1993

[54] LOW PRESSURE RESPONSIVE DOWNHOLD TOOL WITH HYDRAULIC LOCKOUT

[75] Inventors: Kevin R. Manke, Flower Mound; Paul D. Ringgenberg, Carrollton; Roger L. Schultz, Richardson, all of Tex.

[73] Assignee: Halliburton Company, Duncan, Okla.

[21] Appl. No.: 780,161

[22] Filed: Oct. 21, 1991

[51] Int. Cl.[5] ..... E21B 34/00

[52] U.S. Cl. ..... 166/321; 166/240; 166/324

[58] Field of Search ..... 166/321, 264, 372, 374, 166/336, 240, 373

[56] References Cited

U.S. PATENT DOCUMENTS

| | | | |
|---|---|---|---|
| 3,858,649 | 1/1975 | Wray et al. | 166/264 X |
| 3,860,069 | 1/1975 | Wray et al. | 166/264 |
| 3,964,305 | 6/1976 | Wray et al. | 166/321 X |
| 4,355,685 | 10/1982 | Beck | 166/240 |
| 4,422,506 | 12/1983 | Beck | 166/324 |
| 4,429,748 | 2/1984 | Beck | 166/324 |
| 4,489,786 | 12/1984 | Beck | 166/374 |
| 4,515,219 | 5/1985 | Beck | 166/374 |
| 4,537,258 | 8/1985 | Beck | 166/374 |
| 4,557,333 | 12/1985 | Beck | 166/374 |
| 4,617,999 | 10/1986 | Beck | 166/372 |
| 4,633,952 | 1/1987 | Ringgenberg | 166/336 |
| 4,646,838 | 3/1987 | Manke | 166/321 |
| 4,667,743 | 5/1987 | Ringgenberg et al. | 166/321 |
| 5,050,681 | 9/1991 | Skinner | 166/374 |

*Primary Examiner*—Ramon S. Britts
*Assistant Examiner*—Frank S. Tsay
*Attorney, Agent, or Firm*—C. Dean Domingue; James R. Duzan; Lucian Wayne Beavers

[57] ABSTRACT

An annulus pressure responsive well tool includes a selectively actuatable hydraulic bypass for bypassing a pressure differential across a power piston of the tool so that an operating element associated with the power piston will remain in a chosen position during a subsequent change in well annulus pressure.

19 Claims, 6 Drawing Sheets

LOW PRESSURE RESPONSIVE DOWNHOLD TOOL WITH HYDRAULIC LOCKOUT

BACKGROUND OF THE INVENTION

1. Field of the Invention

The present invention relates to annulus pressure responsive downhole tools. Particularly, the present invention provides a low pressure responsive downhole tool with a hydraulic means for locking the tool in a chosen position during subsequent changes in well annulus pressure. 2. Description Of The Prior Art The prior art includes a variety of downhole tools such as testing valves, circulating valves and samplers which are operated in response to a change in well annulus pressure. One particular type of annulus pressure responsive tool has previously been developed by the assignee of the present invention and is generally referred to as a low pressure responsive tool.

An example of such a low pressure responsive tool is shown in U.S. Pat. No. 4,667,743 to Ringgenberg et al. The low pressure responsive tool includes a power piston having first and second sides communicated with the well annulus through first and second pressure conducting passages defined in the tool. A retarding means, such as a metering orifice, is placed in the second pressure conducting passage for delaying communication of a change in well annulus pressure to the second side of the power piston for a sufficient time to allow a pressure differential across the power piston to move the power piston. The movement of the power piston is typically accommodated by compression of a compressible gas such as nitrogen.

It is desirable with such tools to be able to selectively lock the power piston and the associated operating element of the tool in a chosen position so as to disable them during subsequent changes in well annulus pressure The prior art has approached this problem by providing mechanical position control devices such as a lug and slot ratchet assembly like that shown in Ringgenberg et al. U.S. Pat. 4,667,743.

One disadvantage of the use of mechanical position control schemes such as that of Ringgenberg et al. is that the power piston must move through a predetermined series of movements in order to obtain a selected position, as is determined by the various positions defined on the ratchet assembly. Also, the tool is only held in a chosen position for a predetermined number of well annulus pressure cycles

SUMMARY OF THE INVENTION

The present invention provides an improved system for selectively locking the power piston of an annulus pressure responsive tool in place for an indeterminate number of well annulus pressure cycles. The power piston can be reactivated upon demand.

The tool can be run into a well with an operating element of the tool such as a tester valve, in a first position such as a closed position. Upon reaching the desired depth within the well and setting of an associated packer system, well annulus pressure is then increased to a first level above hydrostatic pressure to move the power piston and thus move the tester valve to an open position.

During normal operation of the tool well annulus pressure can be cycled between hydrostatic pressure and said first level to move the power piston and the tester valve between the closed and open positions of the tester valve.

If it is desired to leave the tester valve in an open position while subsequently reducing well annulus pressure back to hydrostatic pressure, this can be accomplished by opening a bypass past the power piston and thereby temporarily deactivating the power piston. While the bypass is open, well annulus pressure can be decreased without moving the tester valve back to its closed position.

The bypass is opened in response to increasing the well annulus pressure to a second level higher than the first level. The power piston is not subsequently reactivated until the well annulus pressure is again raised to the second level.

Thus a hydraulic means is provided for selectively deactivating and reactivating the power piston of an annulus pressure responsive tool.

Numerous objects, features and advantages of the present invention will be readily apparent to those skilled in the art upon a reading of the following disclosure when taken in conjunction with the accompanying drawings

BRIEF DESCRIPTION OF THE DRAWINGS

FIGS. 1A–1I comprise an elevation sectioned view of an annulus pressure responsive flow tester valve having a hydraulically actuated lockout for locking the tester valve in an open position.

DETAILED DESCRIPTION OF THE PREFERRED EMBODIMENTS

Figure 1A:
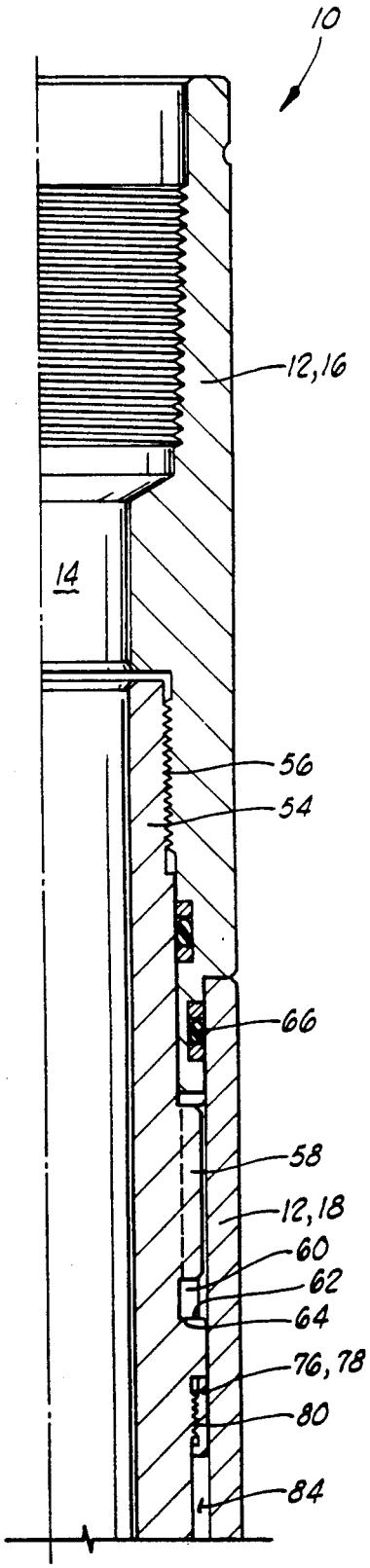

Referring now to the drawings, and particularly to FIGS. 1A–1I, a flow tester valve 10, which may also be generally referred to as an annulus pressure responsive tool apparatus 10, is shown The tool 10 is used with a formation testing string during the testing of an oil well to determine production capabilities of a subsurface formation. The testing string will be lowered into a well such that a well annulus is defined between the test string and the well bore hole A packer associated with the tester valve 10 will be set in the well bore to seal the well annulus below the valve 10 which is then subsequently operated by varying the pressure in the well annulus.

Such a flow test string in general is well known. A detailed description of the general makeup of such a testing string as utilized in an offshore environment and indicating the location of a tester valve in such a string is shown for example in U.S. Pat. No. 4,537,258 to Beck with regard to FIG. 1 thereof, the details of which are incorporated herein by reference.

Referring now to FIGS. 1A–1I of the present application, the tester valve apparatus 10 of the present invention includes a housing 12 having a central flow passage 14 disposed longitudinally therethrough.

The housing 12 includes an upper adapter 16, a valve housing section 18, a shear pin housing section 20, an intermediate nipple 22, a power housing section 24, an upper gas chamber housing section 26, a gas filler nipple 28, a lower gas chamber housing section 30, an oil filler nipple 32, a lower oil chamber housing section 34, and a lower adapter 36. The components just listed are connected together in the order listed from top to bottom with various conventional threaded and sealed connections. The housing 12 also includes an upper inner tubular member 38, an inner connector 40, and a lower inner tubular member 42.

The upper inner tubular member 38 is threadedly connected to gas filler nipple 28 at thread 44 Upper and lower inner tubular members 38 and 42 are threadedly connected to inner connector 40 at threads 46 and 48, respectively. Lower inner tubular member 42 is sealingly received within a bore 50 of lower adapter 36 with an 0-ring seal 52 being provided therebetween.

An upper seat holder 54 is threadedly connected to upper adapter 16 at thread 56. Upper seat holder 54 has a plurality of radially outward extending splines 58 which mesh with a plurality of radially inward extending splines 60 of valve housing section 18. Upper seat holder 54 includes an annular upward facing shoulder 62 which engages lower ends 64 of splines 60 of valve housing section 18 to thereby hold valve housing section 18 in place with the lower end of upper adapter 16 received in the upper end of valve housing section 18 with a seal 66 being provided therebetween.

An annular upper valve seat 68 is received in upper seat holder 54, and a spherical ball valve member 70 engages upper seat 68. Ball valve member 70 has a bore 72 disposed therethrough. In FIG. 1 the ball valve member 70 is shown in its open position so that the bore 72 of ball valve 70 is aligned with the longitudinal flow passage 14 of tester valve 10. As will be further described below, when the ball valve 70 is rotated to its closed position the bore 72 thereof is isolated from the central flow passage 14 of tester valve 10.

The ball valve 70 is held between upper seat 68 and a lower annular seat 74. Lower annular seat 74 is received in a lower seat holder mandrel 76 The lower seat holder mandrel 76 is a cylindrical cage-like structure having an upper end portion 78 threadedly connected to upper seat holder 54 at thread 80 to hold the two together with the ball valve member 70 and seats 68 and 74 clamped therebetween. A Belleville spring 82 is located below lower seat 74 to provide the necessary resilient clamping of the ball valve member 70 between seats 68 and 74.

The cylindrical cage-like lower seat holder 76 has two longitudinal slots, one of which is visible in FIG. 1 and designated by the numeral 84 Within each of the slots such as 84 there is received an actuating arm such as the one visible in FIG. 1 and designated as 86. Actuating arm 86 has an actuating lug 88 disposed thereon which engages an eccentric bore 90 disposed through the side of ball valve member 70 so that the ball valve member 70 may be rotated to a closed position upon upward movement of actuating arm 86 relative to the housing 12 as seen in FIG. 1 Actually there are two such actuating arms 86 with lugs 88 engaging two such eccentric bores such as 90. The details of the ball valve actuation are illustrated and described in detail in U.S. Pat. No. 3,856,085 to Holden et al. and assigned to the assignee of the present invention.

An operating mandrel assembly 92 includes an upper operating mandrel portion 94, an intermediate operating mandrel portion 96, and a lower operating mandrel portion 98.

The upper operating mandrel portion 94 includes a radially outer annular groove 100 disposed therein which engages a radially inwardly extending shoulder 102 of actuating arm 86 so that actuating arm 86 reciprocates with the upper operating mandrel portion 94 within the housing 12.

The lower seat holder mandrel 76 has an outer surface 104 closely received within an inner cylindrical bore 106 of the upper operating mandrel portion 94 with a seal being provided therebetween by annular seal 108.

An upper portion of intermediate operating mandrel portion 96 is received within a smaller bore 110 of upper operating mandrel portion 94. Upper operating mandrel portion 94 carries a plurality of locking dogs 112 each disposed through a radial window 114 in upper operating mandrel portion 94 with a plurality of annular biasing springs 116 received about the radially outer sides of locking dogs 112 to urge them radially inward through the windows 114 against the intermediate operating mandrel portion 96

The operating mandrel assembly 92 is seen in FIGS. 1A–1F where the valve is in an initial run-in open position wherein the ball valve element 70 is open as shown. The tester valve apparatus 10, however, can also be initially run into the well with the ball valve member 70 in a closed position. This is accomplished as follows.

The intermediate operating mandrel portion 96 carries an annular radially outer groove 118 which in FIG. 1 is shown displaced above the locking dogs 112. The intermediate operating mandrel portion 96 slides freely relative to the upper operating mandrel portion 94 until the locking dogs 112 are received within the annular groove 118. Thus, referring to the view of FIG. 1B, the tester valve 10 could be initially assembled with the upper operating mandrel portion 94 displaced upwardly relative to housing 12 and intermediate operating mandrel portion 96 from the position shown in FIG. 1B such that the locking dogs 112 are received and locked in place in groove 118 with the ball valve member 70 rotated to a closed position.

Figure 1B:
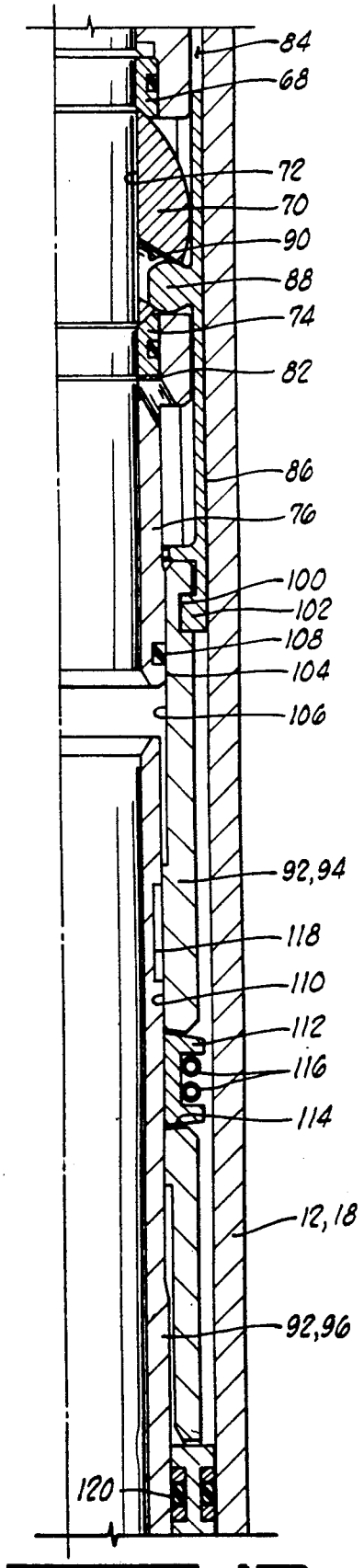
Figure 1C:
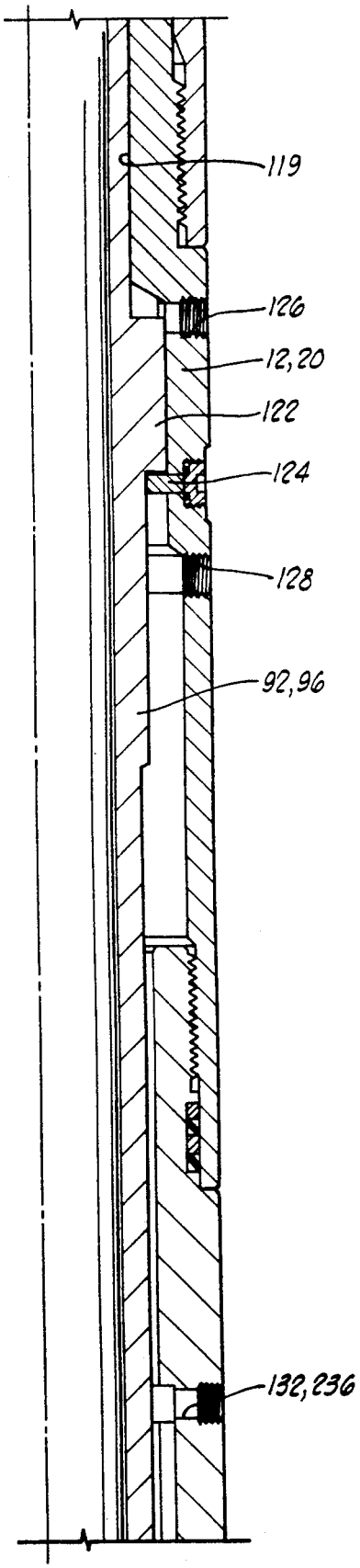

On the other hand, if the tester valve 10 is run into the well with the ball valve 70 in an open position as illustrated in FIG. 1B, the intermediate operating mandrel portion 96 will subsequently be moved downward in a manner further described below toward what would normally be the open position of the tester valve 10. When the intermediate operating mandrel portion 96 has moved sufficiently downward, the locking dogs 112 will lock into place in the groove 118 thus locking the upper operating mandrel portion 94 to the intermediate operating mandrel portion 96 so that subsequent movements of the intermediate operating mandrel portion 96 by the power piston as further described below will act to move the upper operating mandrel portion 94 along with the actuating arms 86 to rotate the ball 70 between its open and closed positions as desired The operating mandrel assembly 92 will move upward relative to housing 12 to rotate the ball valve 70 to a closed position and will move downward relative to the housing 12 to rotate the ball valve member 70 to the open position.

The intermediate operating mandrel portion 96 is closely slidably received within a bore 119 of shear pin housing section 20 with an O-ring seal 120 being provided therebetween. Intermediate operating mandrel portion 96 includes a radially outwardly extending flange 122 which initially has located immediately therebelow one or more shear pins 124 which are fixedly connected to the shear pin housing section 20. The shear pins 124 initially hold the intermediate operating mandrel portion 96 against downward motion relative to housing 12. This prevents premature opening of the ball valve 70 when the ball valve 70 is being run into the well in a closed position.

Shear pin housing section 20 has pressure balancing ports 126 and 128 disposed therethrough to aid in pressure balancing the internal portions of tool 10.

An annular mud chamber 130 is defined between power port nipple 22 and intermediate operating mandrel portion 96. One or more power ports 132 are radially disposed through power port nipple 22 to communicate a well annulus surrounding tool 10 with the mud chamber 130.

An annular oil power chamber 134 is defined between power housing section 24 and intermediate operating mandrel portion 96. An actuating piston 136 is slidably received within the annular oil power chamber 134 with an outer seal 138 sealing against power housing section 24 and an inner seal 140 sealing against intermediate operating mandrel portion 96. The actuating piston 136 may also be generally referred to as a floating piston or an isolation piston.

The actuating piston 136 serves to isolate well fluid, typically mud, which enters the power port 132 from hydraulic fluid typically oil contained in the oil power chamber 134. As further described below, the actuating piston 136 also functions as an actuating means to engage and actuate a bypass valve in the power piston.

An annular power piston 142 is fixedly attached to the operating mandrel assembly 92 and is held in place between a downward facing shoulder 144 of intermediate operating mandrel portion 96 and an upper end 146 of lower operating mandrel portion 98. The intermediate operating mandrel portion 96 and lower operating mandrel portion 98 are threadedly connected at thread 148 after the power piston 142 has been placed about the intermediate operating mandrel portion 96 below the shoulder 144.

Power piston 142 has a shoulder 145 which engages shoulder 144. In an alternative embodiment (not shown) the shoulder 144 of intermediate operating mandrel portion 96 can be provided by a lock ring engaging a groove formed in intermediate operating mandrel protion 96.

The power piston 142 has an upper side 141 and a lower side 143.

Power piston 142 carries an outer annular seal 150 which provides a sliding seal against an inner cylindrical bore 152 of the power housing section 24. Power piston 142 carries an inner annular seal 154 which seals against the intermediate operating mandrel portion 96.

When the power piston 142 is moved upward or downward relative to housing 12 due to pressure differentials thereacross as further described below, the operating mandrel assembly 92 moves therewith to move the ball valve element 70 between its opened and closed positions.

The lower operating mandrel portion 98 carries a radially outward extending flange 156 having a lower tapered shoulder 158 and an upper tapered shoulder 160 defined thereon.

A spring collet retaining means 162 has a lower end fixedly attached to upper gas chamber housing section 26 at thread 164. A plurality of upward extending collet fingers 166 are radially inwardly biased Each finger 166 carries an upper collet head 168 which has upper and lower tapered retaining shoulders 170 and 172, respectively, defined thereon.

In the initial position of lower operating mandrel portion 98 as seen in FIG. 1, the collet head 168 is located immediately below flange 156 with the upper tapered retaining shoulder 170 of collet head 168 engaging the lower tapered shoulder 158 of the flange 156 of lower operating mandrel portion 98. This engagement prevents the operating mandrel assembly 92 from moving downward relative to housing 12 until a sufficient downward force is applied thereto to cause the collet fingers 166 to be cammed radially outward and pass up over flange 156 thus allowing operating mandrel assembly 92 to move downward relative to housing 12. Similarly, subsequent engagement of upper tapered shoulder 160 of flange 156 with lower tapered retaining shoulder 172 of collet head 168 will prevent the operating mandrel assembly 92 from moving back to its upwardmost position relative to housing 12 until a sufficient pressure differential is applied thereacross. In a preferred embodiment of the invention, the spring collet 162 is designed so that a differential pressure in the range of from 500 to 700 psi across power piston 142 is required to move the operating mandrel assembly 92 past the spring collet 162. Thus the spring collet 162 prevents premature movement of operating mandrel assembly 92 in response to unexpected annulus pressure changes.

An irregular shaped annular oil balancing chamber 174 is defined between power housing section 24 and lower operating mandrel portion 98 below power piston 142. Oil balancing chamber 174 is filled with a hydraulic fluid such as oil.

An upper annular nitrogen chamber 176 is defined between upper gas chamber housing section 26 and lower operating mandrel portion 98. An annular floating piston or isolation piston 178 is slidably received within nitrogen chamber 176.

A plurality of longitudinal passages 180 are disposed through an upper portion of upper gas chamber housing section 26 to communicate the oil balancing chamber 174 with the upper end of nitrogen chamber 176. The floating piston 178 isolates hydraulic fluid thereabove from a compressed gas such as nitrogen located therebelow in the upper nitrogen chamber 176.

An annular lower nitrogen chamber 182 is defined between lower gas chamber housing section 30 and upper inner tubular member 38. A plurality of longitudinally extending passages 184 are disposed through gas filler nipple 28 and communicate the upper nitrogen chamber 176 with the lower nitrogen chamber 182. A transversely oriented gas fill port 186 intersects passage 184 so that the upper and lower nitrogen chambers 176 and 182 can be filled with pressurized nitrogen gas in a known manner. A gas filler valve (not shown) is disposed in gas fill port 86 to control the flow of gas into the nitrogen chambers and to seal the same in place therein.

A floating piston or isolation piston 188 is slidingly disposed in the lower end of lower nitrogen chamber 182. It carries an outer annular seal 190 which seals against an inner bore 192 of lower gas chamber housing section 30. Piston 188 carries an annular inner seal 193 which seals against an outer cylindrical surface 195 of upper inner tubular member 38.

The isolation piston 188 isolates nitrogen gas in the lower nitrogen chamber 182 thereabove from a hydraulic fluid such as oil contained in the lowermost portion of chamber 182 below the piston 188.

An annular metering cartridge 194 is located longitudinally between inner tubular member connector 40 and the oil filler nipple 32, and is located radially between the lower gas chamber housing section 30 and the lower inner tubular member 42. The metering cartridge 194 is fixed in place by the surrounding components just identified. Metering cartridge 194 carries an outer annular seal 196 which seals against the inner bore 192 of lower gas chamber housing section 30. Metering cartridge 194 carries an annular inner seal 198 which seals against a cylindrical outer surface 200 of lower inner tubular member 42.

An upper end of metering cartridge 194 is communicated with the lower nitrogen chamber 182 by a plurality of longitudinal passageways 202 cut in the radially outer portion of inner tubular member connector 40.

Figure 5:
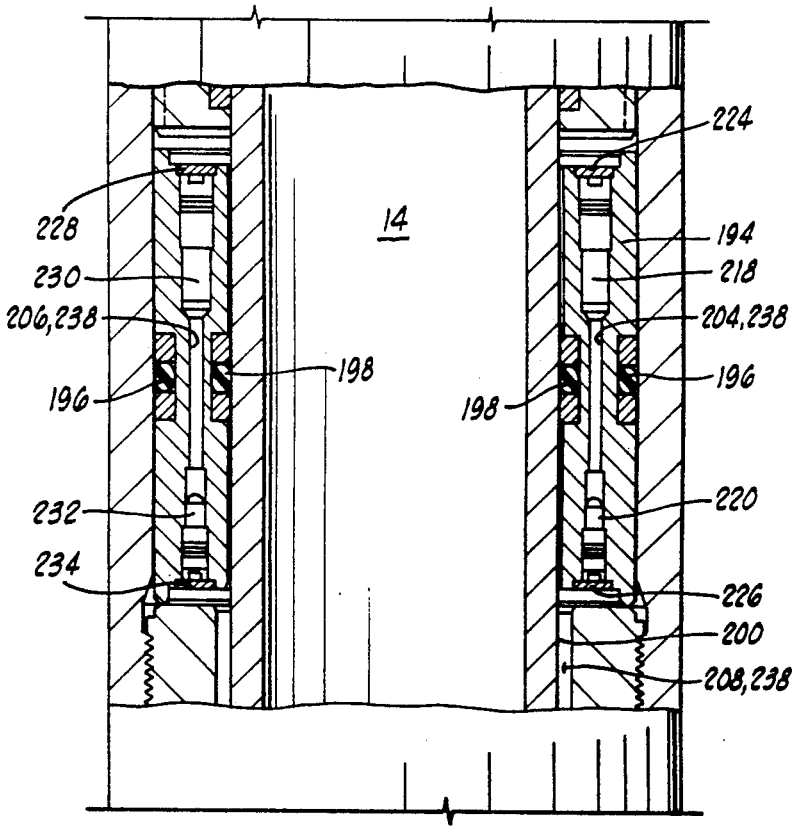
FIG. 5 is a full section view of the metering cartridge portion of the valve seen in FIG. 1H.

The details of the metering cartridge 194 are best seen in the enlarged full section view of FIG. 5.

The metering cartridge 194 has a pressurizing passage 204 and a depressurizing passage 206 disposed longitudinally therethrough, each of which communicate the oil passages 202 thereabove with an annular passage 208 therebelow which leads to a lower oil filled equalizing chamber 210. A lowermost floating piston or isolation piston 212 is slidably disposed in equalizing chamber 210 and isolates oil thereabove from well fluids such as mud which enters therebelow through an equalizing port 214 defined through the wall of lower oil chamber housing section 34.

Devices located in the pressurizing passage 204 control the flow of oil upward from equalizing chamber 210 to the under side of isolation piston 188. The pressurizing passage 204 has disposed therein a pressure relief or check valve 218 and a flow restrictor 220. Upper and lower screens 224 and 226 cover the ends of pressurizing passage 204.

The flow restrictor 220 comprises a small orifice jet which impedes the flow of fluid from equalizing chamber 210 to the oil passages 202 so as to provide a time delay in the transmission of increases in well annulus pressure to the lower side 143 of power piston 142.

Item 218 will usually be a pressure relief valve means which allows flow in an upward direction therethrough when the pressure in equalizing chamber 210 exceeds the pressure in nitrogen chamber 182 by a predetermined value, for example, 400 psi. Pressure relief valve 218 does not permit flow in a downward direction through the pressurizing passage 204. In some instances, a simple one-way check valve may be substituted for the pressure relief valve 218.

The depressurizing passage 206 has disposed therein an a flow restrictor 232 and a pressure relief or check valve 230.

Pressure relief valve 230 allows downward flow therethrough but prevents upward flow therethrough. Again, the pressure relief valve 230 will typically be set to require a 400 psi downward pressure differential to open the pressure relief valve 230.

Flow restrictor 232 impedes the flow of fluid downward through the depressurizing passage 206 and provides a time delay in transmission of decreases in well annulus pressure from the well annulus to the lower side 143 of power piston 142.

Again, in some cases, a simple one-way check valve may be substituted for the pressure relief valve 230.

Upper and lower screens 228 and 234 cover the ends of depressurizing passage 206.

The operation of the pressure relief valves 218 and 230 will be better understood from the following example. After the tester valve 10 has been set at the desired location within a well, typically a pressure increase of 1,000 psi will be imposed upon the well annulus to operate valve 10 so that the pressure exterior of the housing 12 exceeds hydrostatic pressure by 1,000 psi.

The 400 psi pressure relief valve 218 will allow only 600 psi of this pressure increase to be felt on the lower side 143 of power piston 142.

Of course, there will be a significant time delay on the order of two minutes or more, for the entire 600 psi pressure increase to be felt on the lower side 143 of power piston 142 as a result of the fluid flow restrictor 220.

Subsequently, under normal conditions when the bypass through power piston 142 is closed as further described below, when well annulus pressure is dropped back to hydrostatic pressure, the 400 psi pressure relief valve 230 will trap a pressure between the power piston 142 and the metering cartridge 194 at a level 400 psi above hydrostatic pressure The fluid restrictor 220 in the pressurizing passage 204 can generally be referred to as a retarding means 220 for delaying communication of a sufficient portion of an increase in well annulus pressure to the lower side 143 of power piston 142 for a sufficient time to allow a pressure differential from the upper first side 141 to the lower second side 143 of power piston 142 to move the power piston 142 and the attached operating mandrel assembly 92 downward relative to the housing 12 in response to a rapid increase in well annulus pressure.

The power piston 142 is normally reciprocated within the housing 12 in response to changes in well annulus pressure in the following general manner.

A rapid increase in well annulus pressure will be immediately transmitted to the upper side 141 of power piston 142, but will be delayed in being communicated with the lower side 143 of power piston 142, so that a rapid increase in well annulus pressure will create a downward pressure differential across the power piston 142 thus urging it downward within the housing 12.

Similarly, a subsequent rapid decrease in well annulus pressure will normally create an upward pressure differential across power piston 142 moving the power piston 142 upward relative to the housing 12.

These reciprocating motions of the power piston 142 within the housing 12 are transmitted by the operating mandrel assembly 92 to operate the ball valve 70 and rotate it between its open position corresponding to increased well annulus pressure and its closed position corresponding normally to decreased well annulus pressure.

The housing 12 can be generally described as having a first pressure conducting passage means 236 defined therein for communicating the well annulus with the upper or first side 141 of power piston 142. The first pressure conducting passage means 236 includes power port 132, annular mud chamber 130, and oil power chamber 134.

The housing 12 can also be generally described as having a second pressure conducting passage means 238 defined therein for communicating the well annulus with the lower or second side 143 of power piston 142. The second pressure conducting passage means 238 includes oil balancing chamber 174, longitudinal passages 180, upper nitrogen chamber 176, longitudinal passage 184, lower nitrogen chamber 182, longitudinal passages 202, the pressurizing and depressurizing passages 204 and 206, annular passage 208, equalizing chamber 210, and equalizing port 214.

The metering cartridge 194 and the various passages and components contained therein can generally be described as a retarding means disposed in the second pressure conducting passage means 238 for delaying communication of a sufficient portion of a change in well annulus pressure to the lower second side 143 of power piston 142 for a sufficient time to allow a pressure differential between the first side 141 and second side 143 of power piston 142 to move the power piston 142 relative to housing 12.

The ball valve 70 can generally be referred to as an operating element 70 operably associated with the power piston 142 for movement with the power piston 142 between a first closed position and a second open position thereof.

A selectively actuatable bypass means generally designated by the numeral 240 is provided in the power piston 142 for communicating the first and second passage means 236 and 238 and thereby bypassing the power piston 142 so that the ball valve operating element 70 will remain in its open position. More generally, the ball valve 70 can be described as remaining in one of its open and closed positions during a subsequent change in well annulus pressure. It will be appreciated that with a rearrangement of the ball valve and its actuating mechanism, the tool 10 could be constructed to remain in its closed position upon opening of the bypass.

Alternatively, the second pressure conducting passage means 238 can be described as including a first oil chamber 174, a compressed gas chamber made up of chambers 176 and 182, a second oil chamber including passages 202 and chamber 210, and the equalization port 238. Piston 178 can then be described as a first isolation piston 178 separating the first oil chamber 174 and the compressed gas chamber 176, 182. The piston 188 can be described as a second isolation piston 188 separating the compressed gas chamber 176, 182 from the second oil chamber 202, 210. The piston 212 can be described as a third isolation piston separating the second oil chamber 210 from the equalization port 238. Similarly, the first pressure conducting passage means 236 can be described as including the power port 132 and a third oil chamber 134, and the piston 136 can be described as a fourth isolation piston 136 separating the power port 132 and the third oil chamber 134. Then, the bypass means 240 can be generally described as a means for selectively communicating the third oil chamber 134 with the first oil chamber 174.

Figure 1D:
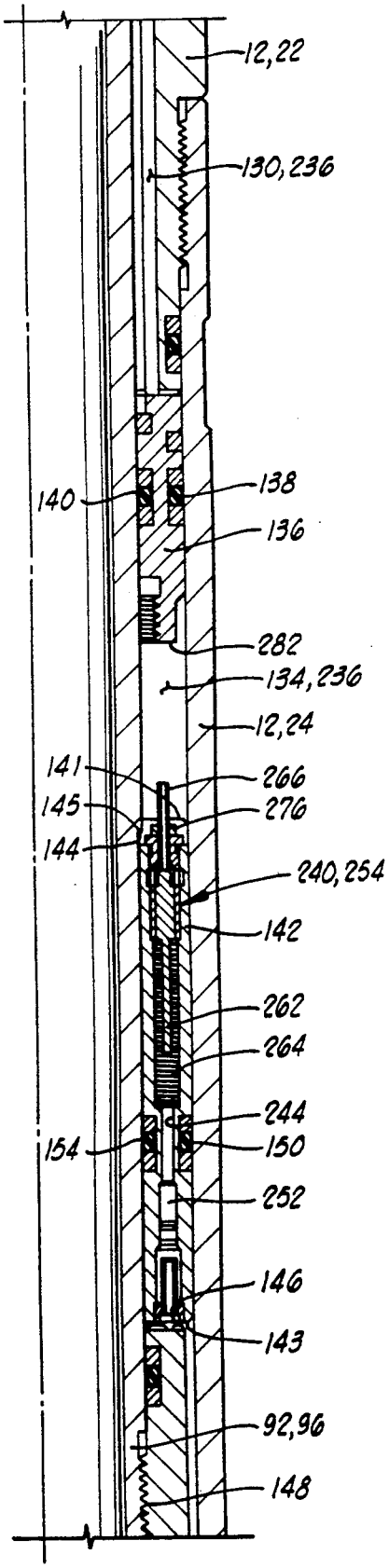
Figure 1E:
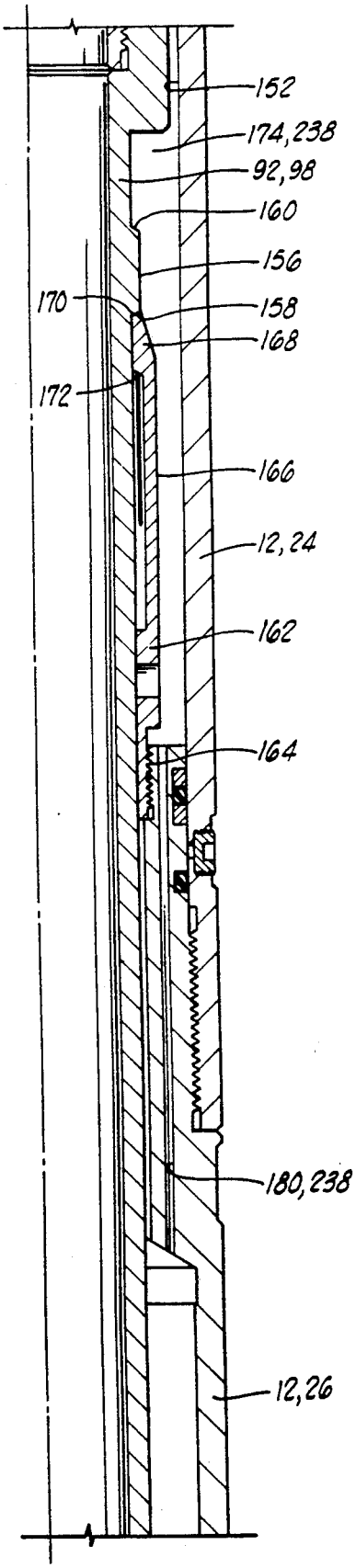
Figure 1F:
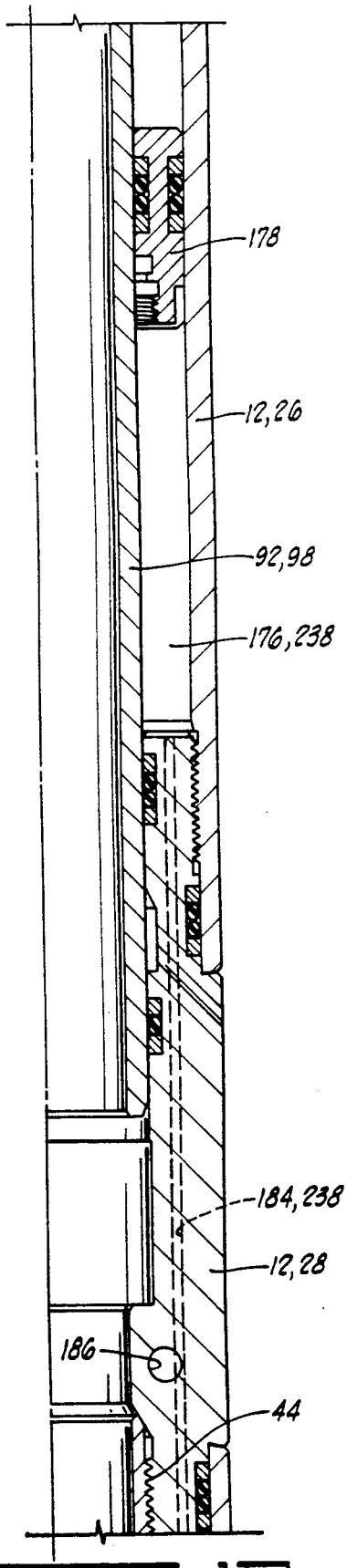
Figure 1G:
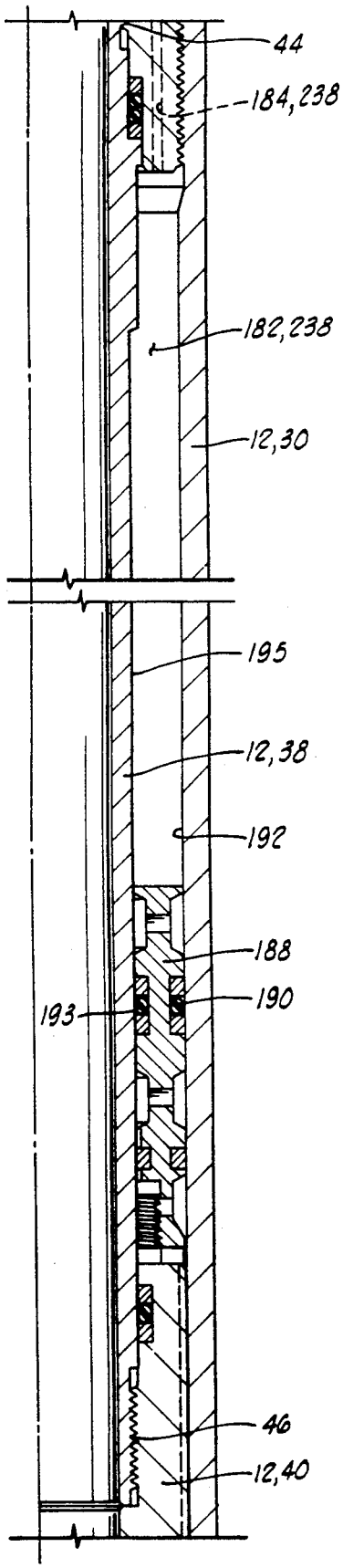
Figure 1H:
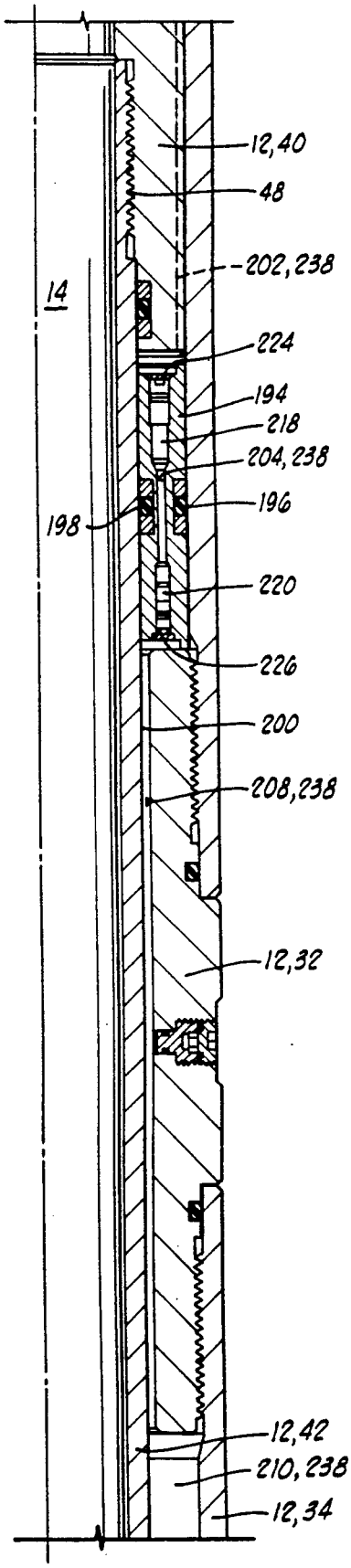
Figure 11:
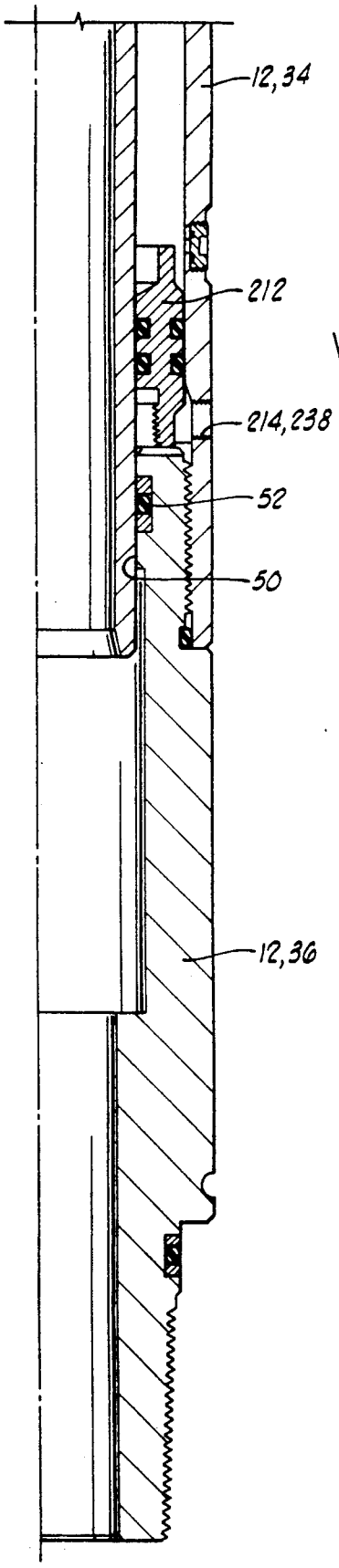
Figure 2:
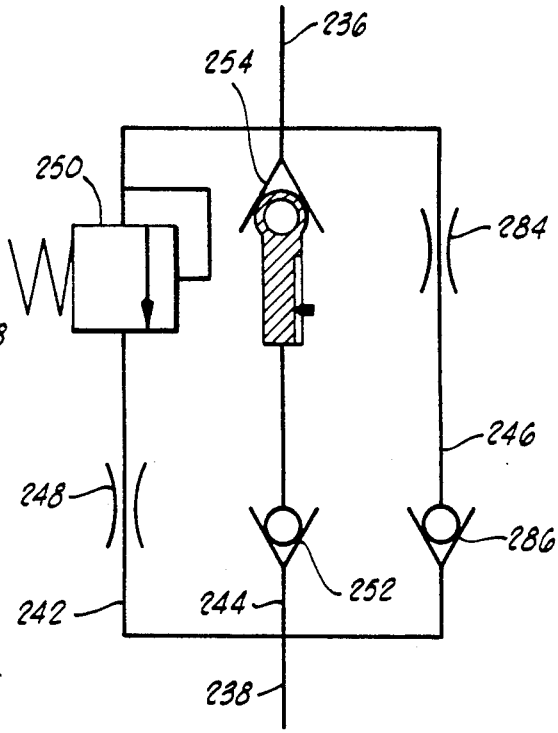
FIG. 2 is a schematic illustration of the flow passages through the power piston with associated check valves, pressure relief valves and metering devices for providing the hydraulic lockout feature.
Figure 3:
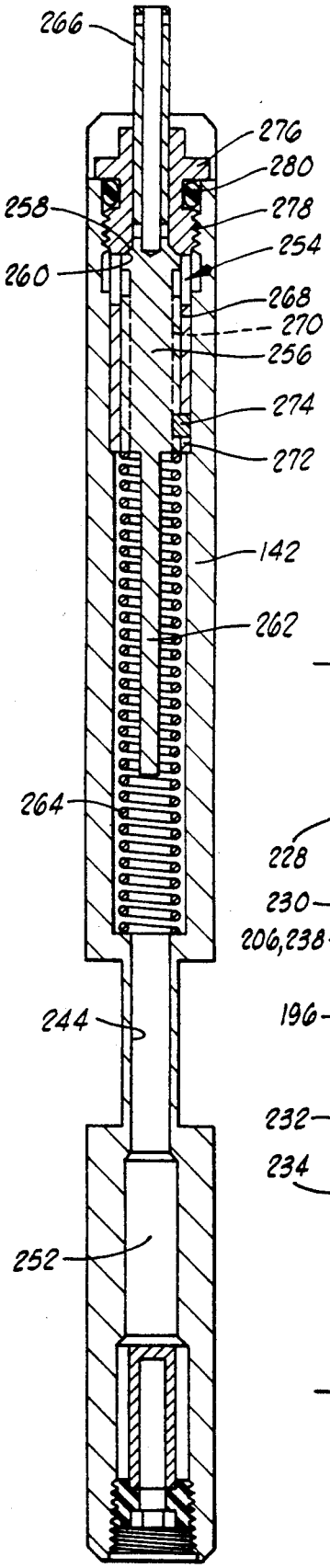
FIG. 3 is an enlarged elevation sectioned view of one flow path through the power piston including an indexing check valve which can be actuated to open or close a bypass through the power piston.
Figure 4:
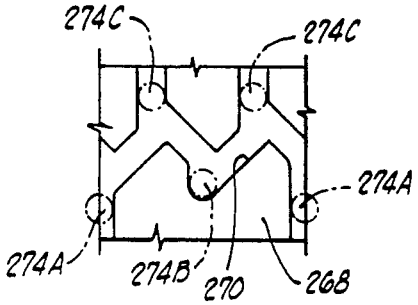
FIG. 4 is a laid-out view of the J-slot mechanism utilized in the indexing check valve of FIG. 3 to releasably retain the check valve in its open position.

Portions of the bypass means are illustrated in FIG. 1D. The hydraulic portions of the bypass means are schematically illustrated in FIG. 2. FIG. 3 is an enlarged view of the bypass valve of bypass means 240, and FIG. 4 is a laid out view of a ratchet means associated with the bypass valve.

The bypass means 240 includes first, second and third hydraulically parallel flow paths 242, 244 and 246 as best seen in FIG. 2. The second flow path 244 and associated components are illustrated in FIG. 1. An enlarged view of the second flow path 244 and those associated components is shown in FIG. 3.

Overall, the three flow paths and the devices contained therein can be best described with regard to the schematic hydraulic flow diagram of FIG. 2.

A metering device or flow restrictor 248 and a pressure relief valve 250 are disposed in the first flow path 24 through piston 142. The pressure relief valve 250 is designed to relieve pressure from the first flow passage means 236 to the second flow passage means 238 when the pressure differential therebetween exceeds the setting of relief valve 250. The relief valve 250 is set so that it will not open during normal operation of the tester valve 10. Thus, if the tester valve 10 is normally operated by increasing well annulus pressure to, for example, 1,000 psi above hydrostatic well annulus pressure, the pressure relief valve 250 will be designed to require greater than 1,000 psi to open.

The tool 10 will be designed so that the selectively actuatable bypass means 240 can be actuated by increasing well annulus pressure to a second level greater than the first level at which the tool is normally operated. For example, the tool might be designed to actuate the bypass means by increasing well annulus pressure to a level of 2,000 psi above hydrostatic. In that example, the pressure relief valve would be designed to be operable at a differential pressure somewhere between those first and second levels, for example, at a pressure differential in the range of 1200 to 1400 psi. When sufficient pressure differential is applied across relief valve 250, it will open allowing hydraulic fluid to be metered slowly through metering device 248 from the oil power chamber 134 to the oil balancing chamber 174.

This will occur in the following manner. Assuming that we begin with well annulus pressure at hydrostatic levels and with the power piston 142 in an uppermost position relative to housing 12 corresponding to a closed position of ball valve 70, the well annulus pressure will be increased for example to 2,000 psi above hydrostatic. This pressure increase will be immediately felt at the top 141 of power piston 142 but will be delayed in reaching the bottom 143 of power piston 142, so that the power piston 142 will rapidly move downward relative to housing 12 thus moving the ball valve 70 to an open position. During this initial movement, the actuating piston 136 will move downward an equivalent amount to accommodate the displacement of the power piston 142. With the well annulus pressure maintained at the 2,000 psi level, however, this pressure differential will then appear across relief valve 250 which will open and which will allow fluid to be slowly metered through metering device 248 thus allowing the actuating piston 136 to move downward toward the power piston 142.

Next, the second flow path 244 and the devices disposed therein will come into play. A check valve 252 and an indexing check valve 254 are disposed in second flow path 244. The check valve 252 always prevents downward flow of fluid through the second flow path 244. The indexing check valve 254 when in its normal closed position will also prevent flow of fluid through second path 244 in an upward direction. When the flow path 244 is in this normal closed situation, the power piston 142 will respond to changes in well annulus pressure. The indexing check valve 254, however, is capable of being moved to a position wherein it is held open thus allowing flow of fluid upward through second flow path 244. When this is accomplished, the second flow path 244 acts as a bypass through the power piston 142 thus disabling the power piston 142.

Thus, the indexing check valve 254 can be described as a selectively actuatable bypass valve 254. Further, the second flow path 244 can be referred to as a bypass passage 244.

The construction of the indexing check valve 254 is best seen in FIG. 3. The valve 254 includes a valve dart 256 having a tapered conical surface 258 thereon which sealingly engages a tapered annular seat 260 when the valve is in a closed position as shown in FIG. 3.

A lower stem 262 extends downward from dart 256 and acts as a spring guide for a compressed helical return spring 264. The return spring 264 serves as a biasing means for biasing the dart 256 toward its closed position An actuating stem 266 extends upward from dart 256 out of the second flow path 244 as best seen in FIG. 1D.

The dart 256 has a cylindrical outer surface 268 which has an endless ratchet path 270 cut therein. The ratchet path 270 may also be referred to as an endless J-slot 270.

The indexing check valve 254 further includes a rotating lug sleeve 272 having a lug 274 extending radially inward therefrom into the endless ratchet path 270.

Upon reciprocating movement of the dart 256, which is further explained below, the lug 274 will move alternatingly between a series of closed positions as designated in phantom lines by 274A in FIG. 4 and a series of open positions as designated in phantom lines by 274B in FIG. 4. During each actuating or deactuating movement of the check valve 254, the lug 274 will also move temporarily to an intermediate position indicated as 274C in FIG. 4.

The annular seat 260 is formed on a threaded valve retainer 276 which is threadedly engaged with power piston 142 at thread 278 with an O-ring seal 280 being provided therebetween.

The indexing check valve 254 is shown in FIG. 3 in its normally closed position with the tapered surface 258 of dart 256 being biased into sealing engagement with seat 260 by the spring 264. The lug 274 is in one of the positions 274A.

Returning to the previous example with the well annulus pressure having been raised to approximately 2,000 psi, the actuating piston 136 moves downward toward the power piston 142 as fluid meters through the first flow path 242. Eventually, the lower end 282 of actuating piston 136 will engage stem 266 of indexing check valve 254 and will push the dart 256 downward until the lug 274 has moved to the position 274C. When well annulus pressure is subsequently decreased back to hydrostatic pressure, the actuating piston 136 will move upward away from power piston 142 as further described below, and the lug 274 will move to a position 274B within ratchet path 270 thus holding the tapered surface 258 of dart 256 out of engagement with seat 260 thus holding the valve 254 in an open position so that fluid can freely flow upward through second flow path 244. Thus, the upward pressure differential which would normally be created across power piston 142 upon decreasing well annulus pressure so as to normally return the power piston 142 to an upward position thus reclosing the ball valve 70 will not occur. Instead, fluid will freely flow upward through second flow path 244.

When well annulus pressure is again increased to normal operating levels, the actuating piston 136 cannot move back downward, because it is hydraulically blocked. There can be no downward flow through either flow paths 244 or 246. There can also be no downward flow through path 242 unless the pressure differential exceeds that required to open the pressure relief valve 250.

Due to the operating pressure of the pressure relief valve 250 only being a few hundred psi above normal operating pressure, it may be that some of the operations which will conducted while the ball valve 70 is locked open will slightly exceed the opening pressure of the pressure relief valve 250 and thus there may be small amounts of fluid which will meter downward during those operations. This will allow small movements of the actuating piston 136 which are accommodated by the normal separation between actuating piston 136 and power piston 142 as seen in FIG. 1D. These pressure increases must of course not be sufficiently high and must not persist for a sufficiently long enough period of time to allow the actuating piston 136 to engage the actuating stem 266 unless it is in fact desired to again reactivate the power piston 142.

This is in part affected by the relationship between the metering through the power piston 142 and the metering through the metering cartridge 194. The metering cartridge 194 is typically set to have approximately twice the fluid flow restriction as is the power piston 142 so that the pressure relief valve 250 can allow the necessary movement of actuating piston 136 when desired, before pressure has sufficiently balanced across the metering cartridge 194 to cause the pressure relief valve 250 to close. For example, the metering device 248 in power piston 142 may be a Visco-Jet ® available from The Lee Company of Westbrook, Conn., having an approximate total rating of 6000 L-OHM, while the metering device 220 in metering cartridge 194 may be a Visco-Jet TM having an approximate total resistance rating of 12,000 L-OHM.

Thus, the power piston 142 has been deactivated and it will no longer respond to changes in well annulus pressure until the well annulus pressure is again increased to a sufficient level to open pressure relief valve 250 thus allowing the actuating piston 136 to again move downward into engagement with stem 266 thus indexing the lug 274 through a position 274C so that it can return to a position 274A thus allowing the valve 254 to reclose thus again reactivating the power piston 142 making it responsive to further changes in well annulus pressure.

The third flow path 246 has a metering device 284 and a check valve 286 disposed therein for allowing metered flow upward through the third flow path 246. This allows the actuating piston 136 to move upward away from the power piston 142 after the bypass valve 254 has been returned to a closed position.

The actuating piston 136 can be generally described as an actuating means 136 which is selectively engageable with the actuating stem 266 for moving the bypass valve 254 to its open position or to its closed position. The actuating piston 136 may in fact be considered to be a part of the bypass means 240.

The endless ratchet path 270 and associated lug 274 may be generally described as a releasable retaining means 270, 274, for retaining the bypass valve 254 in its open position after the actuating piston 136 has moved out of engagement with the actuating stem 266.

It will be appreciated that since the bypass valve 254 is only moved between its open and closed positions in response to an increase in well annulus pressure to the second level, e.g., 2,000 psi above hydrostatic, that the bypass valve 254 can be left in its open position thus deactivating the power piston 142 for an indeterminate number of cycles of well annulus pressure. Thus, enumerable cycles of well annulus pressure may be utilized to operate other tools in the testing tool string while the tool 10 remains hydraulically locked in its open position due to deactivation of the power piston 142. More specifically, this can be described as providing a means for allowing the ball valve 70 to remain in its open position during at least one reciprocating cycle of well annulus pressure.

The bypass valve 254 can be opened and closed any number of times thus repeatedly activating and deactivating the tool 10 without taking the tool out of the well.

Methods Of Operation Of The Well Tool 10

The general methods of operating the well tool 10 are as follows. As previously mentioned, the well tool 10 is made up in a well test string including a number of other devices and the well test string is lowered into a well bore hole to a desired location. Then a packer of the test string is set against the well bore hole to seal the well annulus between the test string and the bore hole above the level of a subsurface formation which is to be tested. This isolates the well annulus above the packer from the well bore below the packer. Then pressure increases in the well annulus above the packer can be utilized to control the various tools of the well test string so as to selectively allow formation fluid from below the packer to flow up through the test string. The actual flow testing of the well is controlled by the flow tester valve 10 disclosed herein.

Although the flow tester valve 10 is shown in FIG. 1 in an initial position wherein it can be initially run into the well with the flow valve 10 open, it will be appreciated by those skilled in the art that the more normal operation is to run the tester valve 10 into the well with the flow valve 70 in its closed position. This is accomplished simply by originally assembling the tool 10 so that the locking dogs 112 are engaged with groove 118 and so that the ball valve 70 is in its closed position with the actuating arm 92 moved upward relative to housing 12 so as to permit the locking dogs 112 to be received in the groove 118.

With the tool 10 in the position just described with the ball valve 70 closed, the well test string is run into the well to the desired location. Then the packer is set to seal the well annulus.

Subsequently, well annulus pressure is increased to at least a first level, e.g., 1,000 psi, above hydrostatic well annulus pressure and that increase is communicated to the top side 141 of power piston 142 while delaying communication of that increase to the bottom side 143 of power piston 142 due to the effect of the metering cartridge 194. This creates a downward pressure differential across power piston 142 which causes it to move downward along with operating mandrel assembly 92 relative to housing 12 thus rotating the ball valve 70 to an open position.

So long as the well annulus pressure has only been increased to this first level, the bypass means 240 will not come into play. The power piston 142 can be reciprocated any number of times within the housing 12 thus moving the ball valve 70 between its open and closed positions as desired.

If at some point it is desired to leave the ball valve 70 open when the well annulus pressure is reduced to hydrostatic pressure, this can be accomplished by first increasing well annulus pressure to a second level, e.g., 2,000 psi above hydrostatic, which is higher than the previously mentioned first level. This second level is also higher than that required to open the pressure relief valve 250. The relief valve 250 opens allowing actuating piston 136 to move downward until it engages actuating stem 266 of bypass valve 254 thus moving the bypass valve 254 to an open position thus opening the second flow path or bypass passage 244 through the power piston 142 and thus temporarily deactivating the power piston 142.

With the bypass valve 254 held in its open position by the ratchet and lug arrangement 270, 274 well annulus pressure can be decreased without moving the power piston 142 upward and without moving the ball valve 70 back to its closed position.

Then, so long as well annulus pressure is not again increased to a level sufficient to open the pressure relief valve 250, well annulus pressure can be increased and decreased any number of times to operate other tools in the well test string or for any other reason.

When it is again desired to activate the power piston 142 so as to reclose the tester valve 70, this is accomplished by again increasing the well annulus pressure to the second level, e.g., 2,000 psi above hydrostatic. In response to this increase in well annulus pressure to the second level the pressure relief valve 250 will again open allowing actuating piston 136 to again move downward into engagement with actuating stem 266 to index the lug 274 within J-slot 270. When well annulus pressure is next returned to hydrostatic pressure the bypass valve 254 will reclose thus reactivating the power piston 142.

The ability to deactivate the power piston and thus leave the ball valve 70 in the open position when well annulus pressure is decreased also allows the well test string to be pulled out of the well with the ball valve 70 open thus allowing the test string to drain as it is pulled from the well.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. An annulus pressure responsive tool apparatus, comprising:

a tool housing;

a power piston slidably disposed in said housing;

a first pressure conducting passage means for communicating a well annulus with a first side of said power piston;

a second pressure conducting passage means for communicating said well annulus with a second side of said power piston;

retarding means, disposed in said second pressure conducting passage means, for delaying communication of a sufficient portion of a change in well annulus pressure to said second side of said power piston for a sufficient time to allow a pressure differential between said first side and said second side of said power piston to move said power piston relative to said housing;

an operating element operably associated with said power piston for movement with said power piston between a first position and a second position of said operating element; and selectively actuatable bypass means for communicating said first and second passage means and thereby bypassing said power piston so that said operating element will remain in one of its said first and second positions during a subsequent change in said well annulus pressure

2. The apparatus of claim 1, wherein said bypass means comprises:

a bypass passage defined through said power piston and communicated with said first and second passage means; and a selectively actuatable bypass valve disposed in said bypass passage, said bypass valve having an open position and a closed position.

3. The apparatus of claim 2, wherein said bypass means further comprises:

resilient biasing means for biasing said bypass valve toward its closed position;

an actuating stem extending from said bypass valve out of said bypass passage; and actuating means, selectively engageable with said actuating stem, for moving said bypass valve to its open position.

4. The apparatus of claim 3, wherein said bypass means further comprises:

releasable retaining means for retaining said bypass valve in its open position after said actuating means has moved out of engagement with said actuating stem.

5. The apparatus of claim 1, wherein:

tool housing has a flow passage disposed therethrough; and said operating element is an operating valve disposed in said flow passage, said first and second positions being closed and open positions of said operating valve.

6. The apparatus of claim 5, wherein:

said selectively actuatable bypass means is further characterized as a means for allowing said operating valve to remain in one of its said closed and open positions during at least one reciprocating cycle of well annulus pressure.

7. The apparatus of claim 6, wherein:

said selectively actuatable bypass means is further characterized as a means for allowing said operating valve to remain in its said open position during at least one reciprocating cycle of well annulus pressure.

8. The apparatus of claim 7, being further characterized as a flow tester valve apparatus, wherein:

said flow passage is a central flow passage;

said operating valve is a flow tester valve; and said selectively actuatable bypass means is further characterized as a means for selectively maintaining said flow tester valve in its open position and allowing pressure in said well annulus to be decreased without reclosing said flow tester valve.

9. The apparatus of claim 1, wherein:

said second pressure conducting passage means includes:

a first oil chamber communicated with said second side of said power piston;

a compressed gas chamber;

a second oil chamber; and an equalization port disposed through said tool housing for communicating with said well annulus; and said apparatus further includes:

a first isolation piston separating said first oil chamber and said compressed gas chamber;

a second isolation piston separating said compressed gas chamber and said second oil chamber; and a third isolation piston separating said second oil chamber and said equalization port.

10. The apparatus of claim 9, wherein:

said retarding means is disposed in said second oil chamber.

11. The apparatus of claim 9, wherein:

said first pressure conducting passage means includes:

a power port disposed through said tool housing for communicating with said well annulus; and a third oil chamber communicated with said first side of said power piston;

said apparatus further includes a fourth isolation piston separating said power port and said third oil chamber; and said bypass means is a means for selectively communicating said third oil chamber with said first oil chamber.

12. The apparatus of claim 1, wherein:

said power piston, said retarding means, and said operating element are constructed so that said power piston moves said operating element from its first position to its second position in response to an increase in well annulus pressure to at least a first level above hydrostatic well annulus pressure, and so that said power piston moves said operating element back from its second position to its first position in response to a decrease in well annulus pressure from said first level back to hydrostatic well annulus pressure; and said bypass means is further characterized as a means for communicating said first and second passage means in response to an increase in well annulus pressure to a second level in excess of said first level.

13. The apparatus of claim 12, wherein:

said first and second passage means each include portions thereof filled with a hydraulic fluid adjacent said first and second sides, respectively, of said power piston;

said apparatus includes an actuating piston disposed in said first pressure conducting passage means; and said bypass means includes:

first, second and third hydraulically parallel flow paths disposed through said power piston;

metering and pressure relief means, operable at a differential pressure between said first and second levels, disposed in said first flow path, for allowing metered flow of hydraulic fluid from said first passage means through said first flow path to said second passage means and for thereby allowing said actuating piston to move toward said first side of said power piston when said well annulus pressure is increased to said second level;

a selectively actuatable bypass valve, disposed in said second flow path, said bypass valve having a closed position wherein flow is prevented in either direction through said second flow path so that said power piston is responsive to changes in well annulus pressure, and an open position wherein flow of hydraulic fluid is permitted from said second passage means through said second flow path to said first passage means so that said power piston is unresponsive to decreases in well annulus pressure when said bypass valve is in said open position, said bypass valve including an actuating stem extending toward said actuating piston for engagement therewith so that when said actuating stem is engaged by said actuating piston said bypass valve is moved between its said open and closed positions; and metering and check valve means disposed in said third flow path for allowing metered hydraulic fluid flow through said third flow path only in a direction from said second passage means to said first passage means to allow said actuating piston to move away from said power piston after said bypass valve is returned to a closed position.

14. A method of operating an annulus pressure responsive downhole tool, said method comprising the steps of:

running said tool into a well with an operating element of said tool in a first position;

(b) increasing well annulus pressure to at least a first level above hydrostatic well annulus pressure and communicating said increase to a first side of a power piston of said tool while delaying communication of said increase to a second side of said power piston for a sufficient time to move said power piston and to thereby move said operating element to a second position;

(c) opening a bypass past said power piston and thereby temporarily deactivating said power piston; and (d) while said bypass is open, decreasing said well annulus pressure back to hydrostatic well annulus pressure without moving said operating element back to its said first position.

15. The method of claim 14, wherein:

said step (c) is accomplished in response to increasing said well annulus pressure to at least a second level higher than said first level.

16. The method of claim 15, further comprising:

(e) after step (d), again increasing said well annulus pressure to at least said second level;

(f) in response to step (e), closing said bypass past said power piston and thereby reactivating said power piston;

(g) decreasing said well annulus pressure back to hydrostatic well annulus pressure; and (h) in response to step (g), moving said power piston and thereby moving said operating element back to its said first position.

17. The method of claim 15, said tool being further characterized as a flow tester valve, wherein:

step (a) is further characterized in that said first position is a closed position of a ball valve element of said flow tester valve;

step (b) is further characterized in that said second position is an open position of said ball valve element of said flow tester valve;

steps (c) and (d) are further characterized as hydraulically locking said ball valve element of said flow tester valve in said open position until well annulus pressure is again increased to at least said second level and then decreased back to hydrostatic well annulus pressure.

18. The method of claim 14, wherein:

step (c) is further characterized in that said bypass is disposed through said power piston.

19. The method of claim 14, wherein:

said step (c) is further characterized as deactivating said power piston for an indeterminate number of well annulus pressure cycles.

* * * * *